United States Patent [19]

Frohbieter

[11] Patent Number: 4,722,200

[45] Date of Patent: Feb. 2, 1988

[54] SEGREGATED AIR SUPPLY FOR AN ACCURATELY TEMPERATURE CONTROLLED COMPARTMENT

[75] Inventor: Edwin H. Frohbieter, Lincoln Township, Berrien County, Mich.

[73] Assignee: Whirlpool Corporation, Benton Harbor, Mich.

[21] Appl. No.: 946,925

[22] Filed: Dec. 29, 1986

[51] Int. Cl.[4] ..... F25D 25/02

[52] U.S. Cl. ..... 62/382; 62/443; 62/465

[58] Field of Search ..... 62/187, 285, 440, 441, 62/382, 443, 465

[56] References Cited

U.S. PATENT DOCUMENTS

| | | | |
|---|---|---|---|
| 2,720,089 | 10/1955 | Morton | 62/382 X |
| 2,994,208 | 8/1961 | Hanson | 62/443 X |
| 3,084,520 | 4/1963 | Jacobs | 62/187 X |
| 3,135,316 | 6/1964 | Foster et al. | 62/443 X |
| 3,263,440 | 8/1966 | Hellstrom | 62/441 X |
| 3,364,694 | 1/1968 | Cohen et al. | 62/382 X |
| 3,609,988 | 10/1971 | Bright | 62/187 |
| 3,638,717 | 2/1972 | Harbour et al. | 62/382 X |
| 4,013,434 | 3/1977 | Kronenberger et al. | 62/382 |
| 4,075,866 | 2/1978 | Williamitis | 62/274 |
| 4,269,035 | 5/1981 | Gelbard | 62/155 |
| 4,488,412 | 12/1984 | Weaver et al. | 62/382 |

*Primary Examiner*—Lloyd L. King

*Attorney, Agent, or Firm*—Hill, Van Santen, Steadman & Simpson

[57] ABSTRACT

A refrigerator is provided with a separately cooled compartment having an air flow independent and segregated from an air flow which cools the main refrigerator compartment. A plate is positioned adjacent to the evaporator and one side of the plate forms a portion of an air passage for air being circulated with the separately cooled compartment. A condensate collection arrangement is provided to capture condensate from the side of the plate within the air passage and to direct the condensate into the condensate collection apparatus provided for the evaporator in the main refrigerator compartment so that only a single waste drain is required.

20 Claims, 7 Drawing Figures

SEGREGATED AIR SUPPLY FOR AN ACCURATELY TEMPERATURE CONTROLLED COMPARTMENT

BACKGROUND OF THE INVENTION

1. Field of the Invention

The present invention relates to refrigerators and more particularly to a refrigerator having a separate container or compartment therein to be chilled below the temperature of the remainder of the refrigerator compartment.

2. Description of the Prior Art

Separately cooled containers or compartments are utilized in refrigerators for storage of various food items. U.S. Pat. No. 3,609,988 discloses a side-by-side refrigerator-freezer in which the refrigerator compartment is divided into a high humidity compartment and a low humidity compartment. Cold air from the freezer is ducted around the exterior of the high humidity compartment and is then ducted through the low humidity compartment before it returns to the freezer. In this manner, there is no flow of air from the freezer through the high humidity compartment. A parallel flow heat exchanger is provided in the air flow path so that the air from the freezer is slightly warmed before it circulates around the exterior of the high humidity compartment and then is recooled prior to entering the low humidity compartment. However, all of the air is directed in a single flow path over the evaporator.

U.S. Pat. No. 4,075,866 discloses a refrigerator defroster-humidifier which utilizes a humidity exchanger in an air flow path between a freezer compartment and a refrigerator compartment in which moisture is extracted from air passing from the refrigerator compartment to the freezer compartment and humidity is returned to air flowing from the freezer compartment to the refrigerator compartment to permit the refrigerator compartment to maintain a relatively high humidity compared to the relatively low humidity of the freezer compartment. A single flow of air across the evaporator plate is provided.

U.S. Pat. No. 4,269,035 discloses a defrost control, including a vertically extending evaporator positioned in thermal contact with the back wall of a chamber. The defrost sensor is arranged above the evaporator and within the boundary layer of thickness of air in natural convection so that the sensor will terminate the defrost operation relative to the temperature of the evaporator.

SUMMARY OF THE INVENTION

The present invention provides for a chilled compartment within a refrigerator which has an air flow segregated from the freezer cooling air stream and the air stream utilized to cool the remainder of the refrigerator fresh food compartment. Thus, if the door or drawer to the compartment were to be left ajar within the refrigerator cabinet, there would not be a short-circuit of air from the chilled compartment supply duct into the fresh food compartment and back to the freezer.

The present invention provides a second, segregated flow of air across a plate in thermal communication with the evaporator to provide the segregated air flow for the chilled compartment. The chilling plate is defrosted by the normal defrost cycle of the evaporator because of the thermal communication with the evaporator, and a condensate collection arrangement of an apertured trough is provided with communicates with the freezer compartment so that the same condensate removal system utilized by the defrost mechanism for the freezer evaporator can be utilized.

DESCRIPTION OF THE PREFERRED EMBODIMENTS

Figure 1:
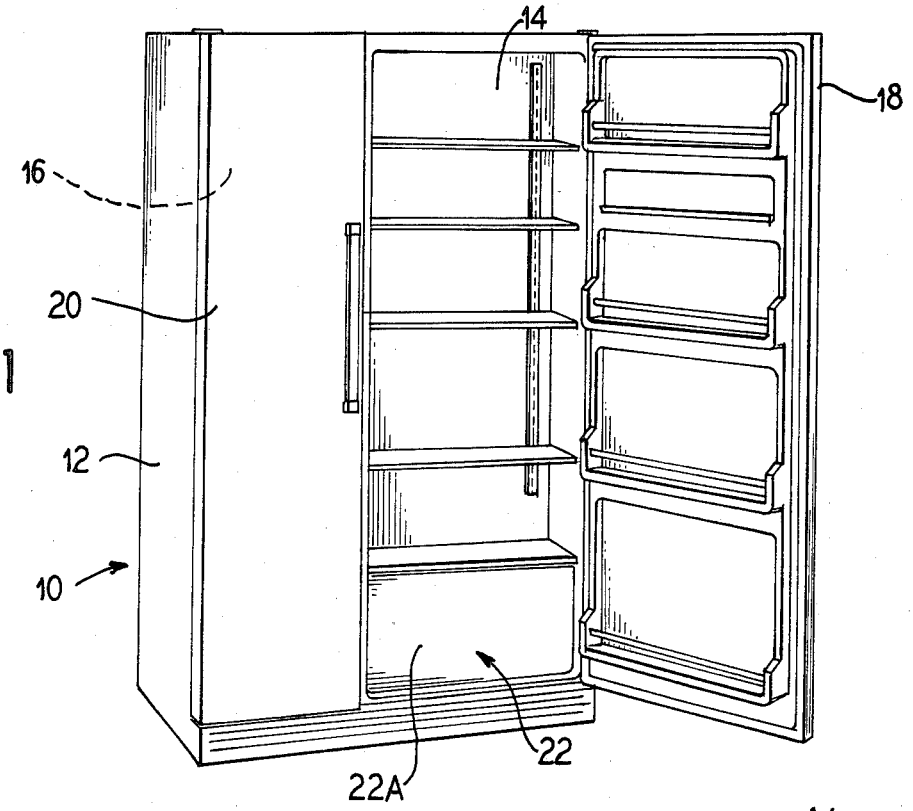
FIG. 1 is a perspective view of a refrigerator-freezer combination unit incorporating the principles of the present invention.

An exemplary embodiment of the invention is shown in FIGS. 1–4 in which there is illustrated a side-by-side refrigerator-freezer generally at 10 having a cabinet 12 with insulated walls divided into a refrigerator fresh food compartment 14 and a freezer compartment 16. Separate openable doors 18, 20 are provided for the refrigerator and freezer compartments respectively. Within the refrigerator compartment 14 there is provided a separate "super chill" compartment 22. Access to compartment 22 may advantageously be provided by a drawer (not shown) having a front wall 22A and disposed in the "super chill" compartment 22 in the closed position of the drawer, or wall 22A may be hinged door providing access to the "super chill" compartment 22.

Figure 2:
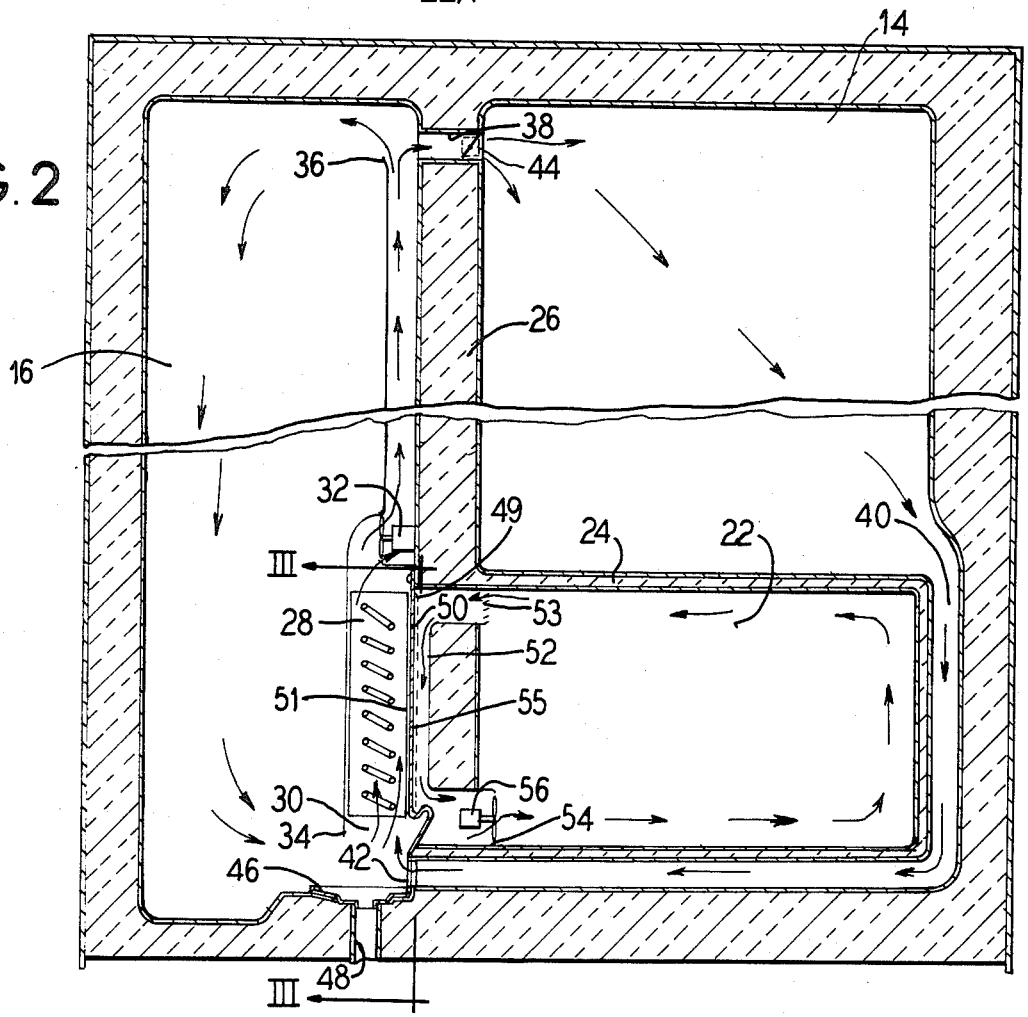
FIG. 2 is a front sectional view showing the various compartments of the refrigerator-freezer of FIG. 1.
Figure 3:
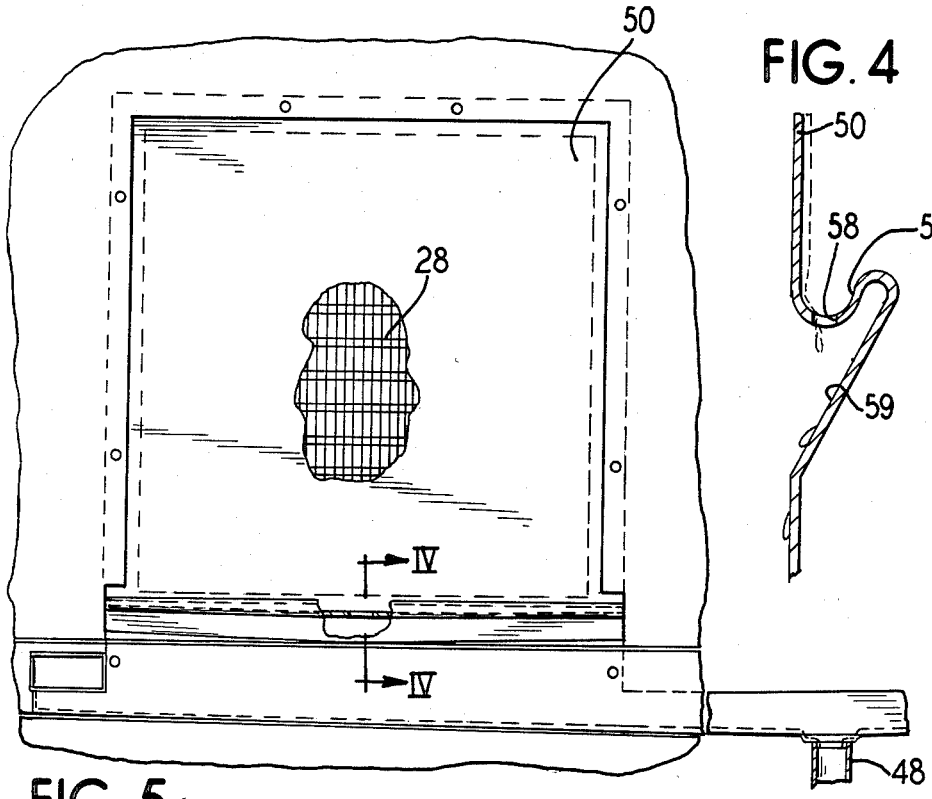
FIG. 3 is a sectional view taken generally along the lines III—III of FIG. 2.
Figure 4:
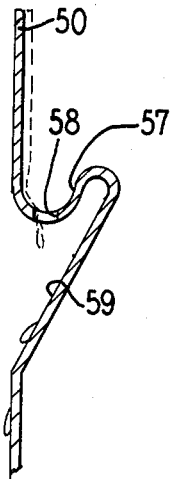
FIG. 4 is an enlarged partial sectional view of the condensate collection means taken generally along the lines IV-IV of FIG. 3.

As illustrated in FIG. 2 the "super chill" compartment 22 is completely separated from the refrigrator compartment 14 by means of an insulated horizonal wall 24. The refrigerator compartment 14 and "super chill" compartment 22 are separated from the freezer compartment 16 by an insulated dividing wall 26.

An evaporator coil 28 is positioned adjacent to the insulated wall 26 within a plenum chamber 30 communicating with the interior of the freezer compartment 16. A motorized fan 32 is provided to cause a flow of air over the evaporator coils 28 to chill the air to a subfreezing temperature. The plenum chamber 30 is open at a bottom end 34 and at a top end 36 to provide the air flow communication with the freezer compartment.

The refrigerator compartment 14 is cooled by means of a flow of air which flows from the freezer compartment through a crossover passage 38 extending through the separation wall 26 and into the refrigerator compartment 14. The air stream is returned to the freezer compartment 16 by means of a duct 40 which extends around the outside of the "super chill" compartment 22 and which has an outlet 42 communicating with the freezer compartment. The temperature within the refrigerator compartment 14 is controlled by means of a movable baffle valve 44 in the cross-over passage 38. As air flows through the refrigerator compartment 14 it picks up moisture and that moisture is deposited on the evaporator coils 28 as the air is cooled. Periodically the evaporator coils 28 undergo a defrost cycle in which the collected frost is melted and caused to drip into a collection receptacle 46 within the freezer compartment which is connected to a waste drain 48.

The "super chill" compartment 22 is cooled by an air stream independent from and segregated from the air streams which cool the freezer compartment 16 and refrigerator fresh food compartment 14. Specifically, an opening 49 is provided in the insulated wall 26 adjacent to the evaporator and a heat transfer plate 50 completely covers the opening into the freezer compartment 16. The plate has a first surface 51 exposed to the freezer compartment and is radiantly cooled by its position adjacent to the evaporator as well as being convectively cooled by the flow of air through the plenum 30. Plate 50 is aluminum and surface 51 is treated with black paint to enhance its radiant heat transfer rate. A duct 52 having a first terminal end 53 and a second terminal end 54, each opening to the "super chill" compartment is provided in which a second surface 55 of the plate 50 forms a portion of the duct. Within the "super chill" compartment, air is caused to flow along the plate 50 is heat exchanging contact therewith by means of a motorized fan 56 positioned within the duct 52 which recirculates the air to the "super chill" compartment 22. The air passing over the plate 50 may be blended with non-cooled, which has been caused to bypass the plate, air prior to reentry of the air stream into the "super chill" compartment 22 so that a relatively constant temperature is maintained throughout the "super chill" compartment. Also, the plate may be provided with vertical fins (similar to those illustrated in the embodiment shown in FIG. 6) to increase the surface area thereof to enhance the heat transfer and cooling provided by the plate.

Along a bottom edge of the plate 50 there is provided a means for collecting melted condensate comprising a trough 57 (best seen in FIG. 4) with at least one aperture 58 formed in a lowermost portion of the trough, which aperture 58 communicates with the freezer compartment. As air passes across the plate 50 moisture is deposited on the plate and, due to the sub-freezing temperature of the plate, frost may build up on the plate. The plate 50 will be heated as the evaporator coils 28 undergo a normal defrosting cycle since the plate 50 is in the thermal communication with the evaporator and thus the melted condensate will collect in the trough and drip through the aperture 58 where it will be directed by a continuing wall portion 59 of the plate to the collection receptacle 46 for the evaporator coils which is located in the freezer compartment. Thus, a separate collection system for the plate is not required and the condensate from the plate does not enter the "super chill" compartment.

Figure 5:
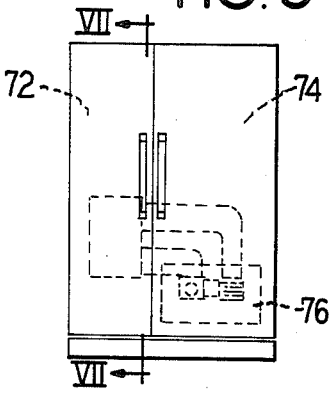
FIG. 5 is a schematic front view of an alternate embodiment of the present invention.
Figure 6:
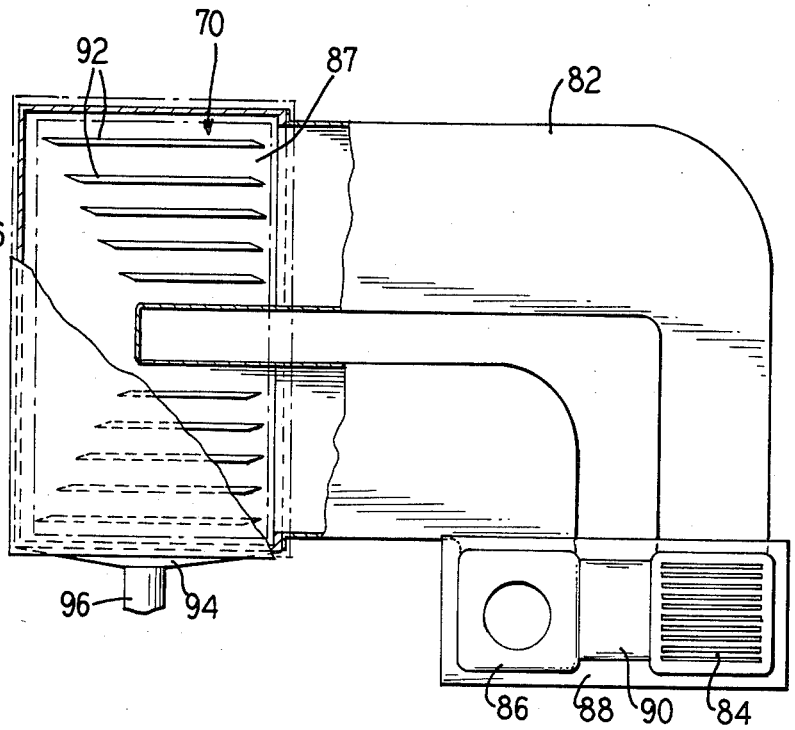
FIG. 6 is a segregated view of the duct work for the embodiment of the invention illustrated in FIG. 5.
Figure 7:
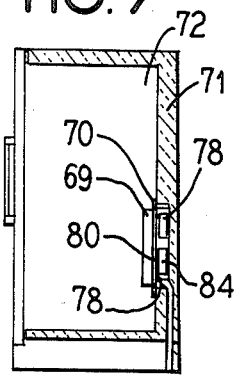
FIG. 7 is a schematic side sectional view of the embodiment of FIG. 5 taken generally along the line VII—VII of FIG. 5.

An alternate embodiment of the present invention is illustrated in FIGS. 5–7 in which the principal change is in the location of an evaporator 69 and adjacent plate 70 which, instead of being placed adjacent to the separation wall 26 between the freezer compartment 16 and refrigerator compartment 14 as illustrated in the embodiment of FIGS. 1–4, they are positioned adjacent a rear insulated wall 71 of a freezer compartment 72, spaced away from the refrigerator compartment 74 and the "super chill" compartment 76. The plate 70 is positioned to completely cover an opening 78 provided in the rear wall 71 adjacent the evaporator 69. A first surface 80 of the plate 70 is exposed to the interior of the freezer compartment. A duct 82, comprising an elongated conduit, having a first terminal end 84 and a second terminal end 86, each opening into the "super chill" compartment and provides communication between the "super chill" compartment and the plate 70 in that second surface 87 the plate 70 forms a portion of the duct 82. The first and second terminal ends of the duct 82 are located in an air fan housing 88 which is used to house a fan (not shown) such as the fan 56 illustrated in FIG. 2 as an exemplary embodiment of a means for circulating air from the "super chill" compartment through the duct 82 in heat exchange contact with the second plate surface.

The housing 88 may also include a bypass passage 90 to provide for a blending of the air stream exiting from the fan as was discussed above to maintain a relatively constant temperature with the "super chill" compartment 76. The evaporator plate 70 is preferably mounted on the back side of the evaporator 69, with the duct 92 proceeding within the insulated rear wall 71 of the freezer compartment.

FIG. 6 also illustrates the use of a plurality of horizontally disposed fins 92 which assist in the cooling of the air. It is anticipated that there will be a frost build up on the evaporator plate 70 and fins 92 as the relatively humid air flows across the plate which is maintained at a sub-freezing temperature. Again, however, there is provided a means for collecting melted condensate comprising a trough 94 formed below the evaporator plate 70 to collect melted frost when the plate is warmed by the normal defrost cycle of the evaporator 65. A drain conduit 96 communicates with and directs the melted frost to a drain conduit within the freezer compartment provided for the disposal of frost melted from the evaporator 69. Thus, a separate drainage disposal arrangement is not required and the condensate from the plate does not enter the "super chill" compartment.

As is evident from the above disclosure, the "super chill" compartment may be located at any position within the refrigerator compartment, either having one wall adjacent to the freezer evaporator, or being spaced therefrom and having a conduit connection to the location of the evaporator. The recirculated air used to cool the "super chill" compartment is independent and is segregated from the air used to cool the freezer and refrigerator fresh food compartments by the plate. Therefore, if a door or drawer of the "super chill" compartment is left ajar, there will not be provided a short circuit of air from the chilled compartment supply duct into the fresh food compartment and back into the freezer since there is not an elevated air pressure within the chilled compartment.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In a refrigerator having a cabinet with insulated walls defining a first compartment and a second compartment, and an evaporator in said first compartment to cool said first compartment; means to cool said second compartment comprising:

means for defining an opening in an insulated wall of said first compartment adjacent said evaporator;

a heat transfer plate completely covering said opening, said plate having a first surface exposed to said first compartment and a second surface;

a duct having a first terminal end and a second terminal end, each opening to said second compartment;

said second plate surface forming a portion of said duct;

means for circulating air from said second compartment through said duct in heat exchange contact with said second plate surface;

means associated with said second plate surface for capturing condensate developed on said plate second surface during defrosting of said second plate and for directing said condensate to said first compartment;

whereby, the condensate will not enter the second compartment but will rather be disposed of along with condensate from said evaporator.

2. In a refrigerator according to claim 1, wherein said insulated wall adjacent said evaporator is a wall separating said first compartment and said second compartment, and said duct comprises a passage through a portion of said wall.

3. In a refrigerator according to claim 1, wherein said insulated wall adjacent said evaporator is spaced from said second compartment, and said duct comprises conduit leading from said second compartment to said plate.

4. In a refrigerator according to claim 1, wherein said means for circulating air comprises a motor driven fan positioned within said duct.

5. In a refrigerator according to claim 4, wherein said first and second terminal ends of said duct are located in an air fan housing which also houses said fan.

6. In a refrigerator according to claim 5, wherein said air fan housing includes a bypass passage to provide a short circuit between said terminal ends of said duct so that a portion of the air will bypass said plate.

7. In a refrigerator according to claim 1, wherein fins are provided on said second surface of said plate to enhance heat transfer at said second surface.

8. In a refrigerator according to claim 1, wherein said means for capturing condensate comprises a trough positioned below said plate.

9. In a refrigerator according to claim 8, wherein said means for returning said condensate to said first compartment comprises an aperture in said trough communicating with said first compartment.

10. In a refrigerator according to claim 1, wherein a pypass passage is provided in said duct to provide a short circuit between said terminal ends of said duct so that a portion of the air will bypass said plate.

11. In a refrigerator having a cabinet with insulated walls defining a first compartment and a second compartment, and an evaporator in said first compartment to cool said first compartment; means to cool said second compartment comprising:

means for defining an opening in an insulated wall of said first compartment adjacent said evaporator;

a heat transfer plate completely covering said opening, said plate having a first surface exposed to said first compartment and a second surface;

a duct having a first terminal end and a second terminal end, each opening to said second compartment;

said second plate surface forming a portion of said duct;

means for circulating air from said second compartment through said duct in heat exchange contact with said plate surface comprising a motor driven fan positioned within said duct;

means positioned below said second plate surface for capturing condensate developed on said plate second surface during defrosting of said second plate and an aperture in said trough means communicating with said first compartment for directing said condensate to said first compartment;

whereby the condensate will not enter the second compartment but will rather be disposed of along with condensate from said evaporator.

12. In a refrigerator according to claim 11, wherein said insulated wall adjacent said evaporator is a wall separating said first compartment and said second compartment, and said duct comprises a passage through said wall.

13. In a refrigerator according to claim 11, wherein said insulated wall adjacent said evaporator is spaced from said second compartment, and said duct comprises conduits leading from said second compartment to said plate.

14. In a refrigerator according to claim 11, wherein said first and second terminal ends of said duct are located in an air fan housing which also houses said fan.

15. In a refrigerator according to claim 11, wherein fins are provided on said second surface of said plate to enhance heat transfer at said second surface.

16. In a refrigerator according to claim 11, wherein a bypass passage is provided in said duct to provide a short circuit between said terminal ends of said duct so that a portion of the air will bypass said plate.

17. In a refrigerator having a cabinet with insulated walls defining a first compartment and a second compartment, and an evaporator in said first compartment to cool said first compartment; means to cool said second compartment comprising:

a heat transfer plate having a first surface exposed only to said first compartment and a second surface not exposed to said first compartment;

air passage means having a first terminal end and a second terminal end, each opening to said second compartment, said air passage means being segregated from said first compartment;

said second plate surface forming a portion of said air passage means;

means for circulating air from said second compartment through said air passage means in heat exchange contact with said second plate surface;

whereby, said second compartment will be cooled by an air stream segregated from said first compartment by said plate.

18. In a refrigerator according to claim 17, including means associated with said second plate surface for capturing condensate developing on said second plate surface and for directing said condensate to said first compartment, whereby said condensate will not enter the second compartment.

19. In a refrigerator according to claim 17 wherein said first surface is covered with a black coating.

20. In a refrigerator having a cabinet with insulated walls defining a first compartment and second compartment, and an evaporator in said first compartment to cool said first compartment; means to cool said second compartment comprising:

a solid heat transfer plate defining an air barrier between said first and second compartments with a first surface exposed to said first compartment and a second surface;

air passage means having a first terminal end and a second terminal end, each opening to said compartment;

said second plate surface forming a portion of said air passage means;

means for circulating air from said second compartment through said air passage means in heat exchange contact with said second plate surface;

whereby, said second compartment will be cooled by an air stream segregated from said first compartment by said plate.

* * * * *